United States Patent [19]

Stobb

[11] Patent Number: 4,487,405

[45] Date of Patent: Dec. 11, 1984

[54] METHOD AND APPARATUS FOR SHEET GATHERING IN A SIDE-BY-SIDE GENERALLY VERTICAL EDGE ALIGNMENT

[75] Inventor: Walter J. Stobb, Pittstown, N.J.

[73] Assignee: Stobb, Inc., Clinton, N.J.

[21] Appl. No.: 472,725

[22] Filed: Mar. 29, 1983

[51] Int. Cl.[3] ..... B65H 39/02

[52] U.S. Cl. ..... 270/58; 198/644

[58] Field of Search ..... 270/54, 56, 58, 59; 198/644

[56] References Cited

U.S. PATENT DOCUMENTS

| | | | |
|---|---|---|---|
| 2,166,709 | 7/1937 | Swanson | 270/56 |
| 3,052,468 | 9/1960 | Cutaia et al. | 271/71 |
| 3,416,786 | 12/1965 | Stobb | 270/54 |
| 3,510,119 | 10/1967 | Linden | 270/54 |
| 4,168,828 | 9/1979 | McLear | 270/54 |
| 4,221,373 | 9/1980 | Hans | 270/54 |

FOREIGN PATENT DOCUMENTS

| | | | |
|---|---|---|---|
| 2702738 | 9/1977 | Fed. Rep. of Germany | 270/58 |

*Primary Examiner*—E. H. Eickholt

*Attorney, Agent, or Firm*—Arthur J. Hansmann

[57] ABSTRACT

A method and apparatus for collecting a plurality of sheets together from a row of sheet stacks. The collection is made in upstanding buckets or trays wherein the sheets can be collected in the upright position standing on their lower edges. The system provides for high-speed collection and the equipment can be compact. The buckets are J-shaped, and they move along a line which is at right angles to the axis of the feeder cylinder.

7 Claims, 4 Drawing Figures

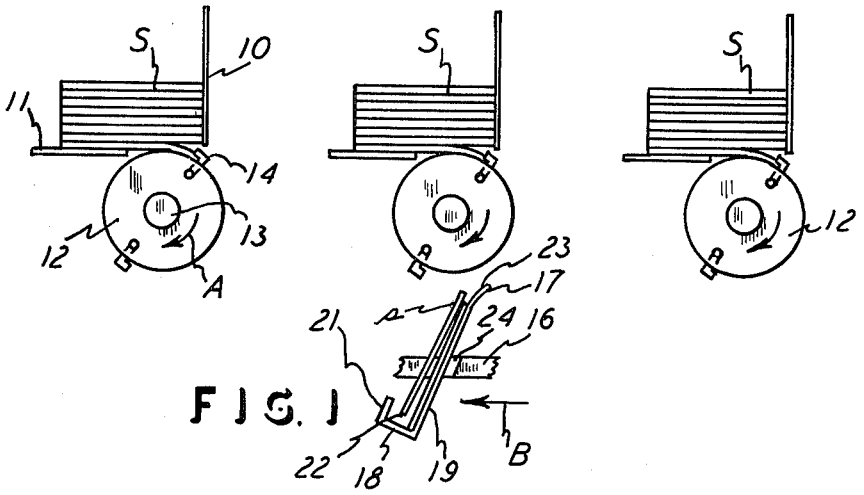
FIG. 1
FIG. 2
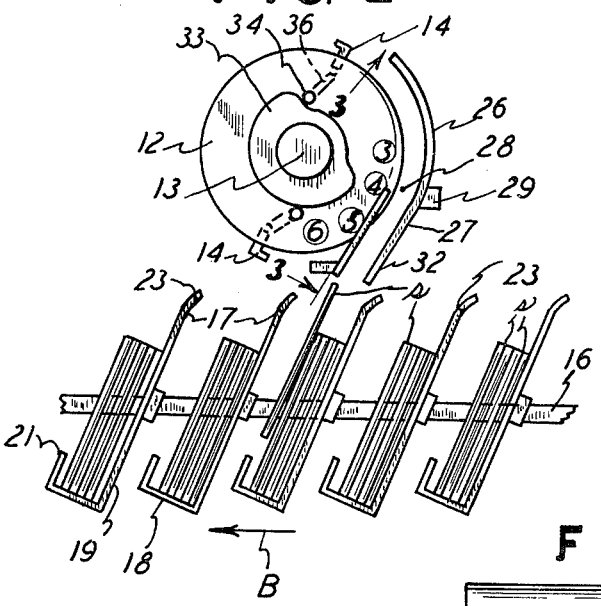
FIG. 3
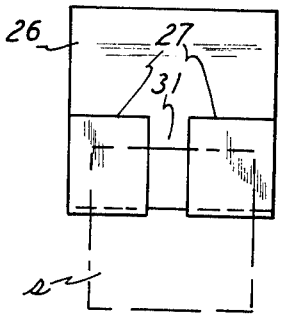
FIG. 4
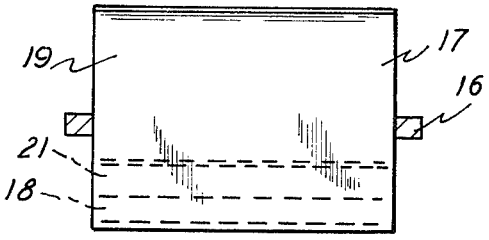

METHOD AND APPARATUS FOR SHEET GATHERING IN A SIDE-BY-SIDE GENERALLY VERTICAL EDGE ALIGNMENT

This invention relates to a method and apparatus for gathering sheets, and, more particularly for a method and apparatus for gathering sheets from a plurality of sheet stacks arranged in a line to collect the sheets in stack form and along a raceway moving parallel to the line.

BACKGROUND OF THE INVENTION

It is common practice in the graphic arts industry to gather or collect sheets from various stacks and to do so on a conveyor or along a raceway which moves adjacent the various stacks while each stack contributes a sheet onto the raceway. One example of that prior art is seen in U.S. Pat. No. 3,510,119 which simply shows a plurality of sheet stacks in a line and a conveyor moving past the stacks to collect a sheet from each stack and thereby form a final magazine or book or the like. In the prior art arrangement, the collected sheets are laid flat on the raceway or collecting conveyor, and thus the full-length or width (depending upon orientation of the sheet) of the sheet occupies the corresponding length of the collecting conveyor or raceway. This means that the speed of movement of the collecting conveyor or raceway must be slow enough to correspond with the feeding equipment which is depositing the sheet onto the collecting conveyor or raceway so that each deposited sheet can be properly positioned thereon. Also, the prior art system drops the sheets in a flat orientation and thus an airplane effect is created, and therefore the sheets must also be collected at speeds which allow for that impediment.

In the prior art systems, it is common practice to operate at maximum speeds which produce 300 books per minute, and this requires a collecting conveyor or raceway speed of 450 feet per minute, for common dimensions of the sheet being collected. With the present invention which avoids the flat or horizontal collecting position for the sheet, the collecting conveyor or raceway speed can be as slow as 75 feet per minute, and that is less than 17% of the aforementioned prior art speed while still collecting the same quantity of books, as mentioned.

Accordingly, it is an object of this invention to provide an improved method and apparatus for collecting sheets at a speed higher then that heretofore possible, and to also accomplish this objective while collecting the sheets in a more accurately aligned manner than that heretofore possible.

Still further, the present invention provides for the high speed collection mentioned and to do so with more compact equipment and thus less space being required.

Further, since the collecting conveyor or raceway of this invention needs to move only at a fraction of the speed of the prior art equipment, the method and apparatus of this invention provides for a greater quantity of books produced per unit of time than that possible with prior art equipment, such as far exceeding the prior art production rate of 300 books per minute.

Still further, the present invention provides a method and apparatus for collecting books of varying sizes but at the high speed and in the compact nature mentioned herein.

BRIEF DESCRIPTION OF THE DRAWINGS

FIG. 1 is a side elevational view of a preferred embodiment of this invention.

FIG. 2 is an enlarged side elevational view of a portion of FIG. 1, with parts added thereto.

FIG. 3 is a view taken along the line 3—3 of FIG. 2.

FIG. 4 is a right side view of one part of FIG. 2.

DETAILED DESCRIPTION OF THE PREFERRED APPARATUS

FIG. 1 shows a plurality of sheet stacks S disposed in a row or line and suitably supported by members 10 and 11, for instance, it being understood that the stacks S and their support members are conventionally arranged. Also, of conventional arrangement, is a gripper cylinder 12 disposed below each stack S and rotatable in the direction of the arrow designated A and rotatable on a support or shaft 13. Each cylinder 12 has a conventional sheet gripper 14 thereon, and, two such grippers are shown on each cylinder 12 though there could be various numbers of grippers 14.

Thus, in a conventional arrangement, the gripper cylinders 12 operate under each stack S to remove one of the sheets or signatures from the stack S, by means of the gripper 14, and thus move the gripped sheet or signature to a collector moving adjacent the gripper cylinders 12. As mentioned, that basic arrangement is conventional and could be as indicated in U.S. Pat. No. 3,510,119. Also, U.S. Pat. No. 3,052,468 shows the movement and collection of sheets, and, in this instance, the sheets are collected in a somewhat upstanding position, though they are not collected on a moving conveyor or raceway in a collating fashion, as in the present invention, and there is no sheet or signature collected from each of a plurality of stacks to form a collection of the various sheets or signatures into one final stack, as in this invention.

FIG. 1 further shows a collecting conveyor or raceway 16 which moves in the direction of the arrow designated B and thus moves in a line parallel to the stacks S and parallel to the feeders or gripping cylinders 12, as shown. A collecting bucket 17 is suitably affixed to the conveyor 16 to move therewith and to present a floor 18 and a back rest 19 and a toe portion 21, all for guiding and confining a sheet or signature s which is taken from the stack S and deposited end-wise into the bucket or tray 17, as indicated in FIG. 1.

In that method and system shown in FIG. 1, the sheet s is deposited into the bucket or tray 17 edgewise so that the sheet leading edge 22 is directed downwardly, substantially in a vertical direction but, as shown, at an angle of perhaps 10 to 15 degrees off a vertical plane. In that arrangement, the sheet s is not subjected to the airplane effect which it would have if the sheet were dropped onto a collecting conveyor in a horizontal plane, and thus the sheets can be accurately and more quickly accumulated in their upstanding or vertical orientation described herein. That is, the wall 19 of the bucket 17 is substantially vertical, and it has an upper portion 23 which is curved rearwardly relative to the direction of movement shown by arrow B, and thus the portion 23 permits the guidance of the sheet s into the bucket 17 to assure that a plurality of sheets s will be collected in the bucket 17 in the aligned and stacked relationship disclosed herein. FIG. 1 is showing two sheets s in the bucket 17 with the one sheet in a free-fall position and not yet fully settled into the bucket 17 since it is schematically displayed as having just been released by the gripper 12 immediately above it, that showing being for the purpose of clear disclosure of how the gripper 12 moves a sheet s from the stack and deposits it into the bucket 17. Also, the bucket 17 is suitably affixed to a conventional type of conveyor or belt 16, such as by a mounting or attachment bracket designated 24 interconnecting the bucket 17 and the conveyor 16.

The orientation or the bucket wall 19 is substantially vertical, as mentioned, and, more specifically, it has only a slight back angle or lean to permit the sheets s to be collected and stood on edge, as shown, and to avoid falling forward, though it will be seen and understood that the direction B of the conveyor 16 also contributes to the upright or on edge support of the sheets in the tray 17, since the sheets are subjected to forward air pressure in the movement of the conveyor through the air. That is, the orientation of the back lean or angle to the wall 19 is described as being a back lean or leaning back at the top relative to the direction B. Also, the length of the floor 18 is adequate to permit an accumulation of plurality of the sheets s, and the toe 21 can be utilized to guide the sheets s into the tray, in the event that they would otherwise tend to fall beyond the floor 18, and the toe 21 also prevents the sheets from sliding off the bottom 18.

FIG. 2 shows a plurality of the trays or bucket 17 affixed to the conveyor 16, and it also shows a plurality of sheets s in each of the buckets 17. Further, FIG. 2 shows that the buckets 17 are in an overlapping relationship on the vertical plane, that is, the bucket upper portion 23 overlaps with the bucket floor 18 such that any sheet s dropping from any gripper cylinder 12 must encounter the floor 18 and cannot drop therepast when the sheet s is dropping vertically or substantially vertically, as shown and described herein. Again, FIG. 2 shows one sheet s directly below the cylinder 12 and in a free-fall position moving into the receiving bucket 17, having just been released by the cylinder gripper 14. Of course the sheets s will form the proper stack in each bucket 17 with the appropriate sheet s being positioned relative to the other sheets in the bucket 17, all to form the final book or magazine.

FIG. 2 also shows a sheet guide 26, to the outside of the path of movement of the sheet s with respect to the gripper 12, and a sheet guide 27 is shown to the inside of the path of sheet movement. Thus the sheet s will pass in the space 28 defined by the guides 26 and 27 which terminate at their lower ends to be tangential with the cylinder 12 and thus to direct the sheets s tangentially off the cylinder 12 and substantially vertically and downwardly into the appropriate tray 17 passing underneath the cylinder 12, as shown and described. The guides 26 and 27 are in fixed positions by being mounted on a frame or brackets or the like, such as the bracket 29 behind the guide 26. Also, FIG. 2 shows the numerals 3 through 6 on the cylinder 12, and these represent the hours on the face of a clock, and will therefore be seen that the straight guide portions of the guides 26 and 27, that is the lower portion of the guide space 28, are in the four to five o'clock area on the clock face circle. That is the location where the gripper 14 will release the sheet s and then the guides 26 and 27 will guide the falling sheet s substantially vertically into the bucket 17.

FIG. 3 shows that the guide 27 can have a space 31 intermediate thereon so that the gripper 14 can pass through the guide 27 which is shown in FIG. 2 to intersect the circumference of the gripper cylinder 12 and therefore engage the left face of the sheet s and strip the sheet s away from the cylinder 12 for the free-fall action described. Therefore, the opposite lateral ends of the guide 27 will flank the cylinder 12 so as of course to avoid interference therewith but to intercept the sheet s and guide it edgewise downwardly as disclosed herein.

FIG. 2 therefore shows that the guides 26 and 27 have their lower straight portions aligned with and parallel to the bucket wall 17 for directing the sheets s edgewise into the bucket 17. Also, the sheet released from the gripper 14 could fully engage only the outer guide 26 at its lower portion 32, and that could be adequate for guiding the falling sheet into the bucket 17 while the bucket is moving leftwardly below the cylinder 12 and as viewed in FIG. 2. Thus, the guide portion 32, as well as the guide 27, is parallel to the tray back wall 19.

As mentioned, the trays 17 overlap each other on the vertical plane, and they are spaced apart only a very short distance, compared to the height of the sheets s as shown in FIG. 4 and which would be the spacing required on a conveyor, such as the conveyor 16, if the sheets s were laid flat thereon, including some allowance for additional spacing between the flat sheets s on the conveyor. Therefore, the conveyor 16 can operate at a fast speed and the sheets s will be collected in greater quantities on a given length for the conveyor 16, compared to the same given length for any prior art collecting conveyor or raceway, and therefore the greater production is possible with the present invention, as mentioned at the outset herein. In actuality, the spacing from a center to center relationship between consecutive trays 17 could be 2 to 3 inches, depending upon the thickness of the product or sheets to be collected in the trays. Also, the dimension of the sheets parallel to the axis of the cylinder 12 can be of different sizes, such as the 11-inch or 16-inch size of standard arrangement, and the width of the trays 17, as viewed on the horizontal in FIG. 4, would simply be adequate to provide for varying dimensions of the sheets. Still further, the gripper cylinders 12 can be made of a much smaller diameter compared to the conventional sizes, and therefore the equipment of this invention is much more compact than that of the prior art.

FIG. 2 also indicates an arrangement for opening and closing the conventional grippers 14, and that arrangement is shown to include a fixed cam 33 and cam followers 34 for each gripper 14 connected to the grippers through an arm 36. Therefore, the grippers will close when underneath the stack S and will open when the leading edge 22 of the sheet s in within the control of the guides 26 and 27, and, as mentioned, that can be in the four or five o'clock position.

Therefore, the sheets are deposited into collecting trays or buckets 17 at an angle of substantially 90 degrees to the line of movement of the collecting conveyor or raceway 16, and the sheets are deposited into the trays at substantially vertical orientation and in a side-by-side relationship with the sheet leading edge being its lowest edge in the tray 17. Of course the sheets are initially removed from the stack S in an arcuate path and are then guided into a linear or straight path and finally deposited into the bucket 17. Also, in the conventional arrangement, the sheets s are commonly folded into signatures, and thus the leading edge 22 is a folded edge which is most appropriate for dropping into the tray 17 without any airplane effect of consequence. Those sheets s are thus first moved horizontally out of the stack S and then turned substantially 90 degrees to the substantially vertical plane and deposited in that orientation. The pick up of the sheets s being at the 12 o'clock position and the release or deposit point of the sheets s being at the approximately four o'clock position. The trays or buckets 17 are therefore three-sided receivers which move continuously past the delivering cylinders 12, and the buckets overlap in the vertical plane so that no sheets s can drop beyond the buckets 17. The bucket back wall 19 and the bucket floor 18 are at right-angles to each other, for the substantially vertically upright and on edge support of the sheets s. The buckets 17 are open on their sides, and they J-shaped in their side view, as shown.

Further, in present-day gathering systems, the raceway extends parallel to the axis of the gripper or feeder cylinders, such as shown in U.S. Pat. Nos. 2,166,709 and 3,416,786 and 3,510,119. Conversely, in the present invention, the raceway or collector 16 extends transverse, at ninety degrees, to the feeder cylinder axes, as shown in FIGS. 1 and 2. Thus, the greater accuracy of signature alignment on the raceway is achieved, and the compact apparatus is possible, including utilizing a smaller feeder cylinder diameter.

What is claimed is:

1. In a sheet gathering method for collecting a plurality of folded sheets together from a row of sheet stacks, removing sheets from said sheet stacks and depositing the removed sheets into stacks onto a raceway movably extending horizontally in a line past said sheet stacks, the improvement comprising the steps of moving the removed sheets in an edgewise direction with the fold thereof leading and toward said raceway and at an angle of less than ninety degrees to the line of movement of said raceway, guiding the removed sheets into a linear path on a guide intermediate said sheet stacks and the raceway, releasing the removed sheets onto said guide and subsequently depositing the sheets onto said raceway at said angle slightly off a vertical orientation in full side-by-side relation with the leading folded edges of the removed sheets being lowest whereby the stacks on said raceway are inclined on edge, and supporting the side-by-side sheets on said raceway and in the orientation slightly off vertical.

2. The sheet gathering method as claimed in claim 1, wherein the removed sheets are initially removed from said sheet stack at a twelve o'clock position and are moved through an arc and released to the guide at a four o'clock position.

3. The sheet gathering method as claimed in claim 1, wherein the removed sheets are secured on the raceway by three-sided members spaced along the raceway and which are inclined at the orientation slightly off vertical.

4. In sheet gathering apparatus for collecting a plurality of sheets together from a row of a plurality of sheet stacks, a collector conveyor movably extending past said row of sheet stacks, a rotatable feeder intermediate each of said sheet stacks and said collector conveyor for removing sheets from said sheet stacks and depositing the removed sheets onto said collector conveyor, the improvement comprising a plurality of receivers attached to said collector conveyor and spaced therealong for receiving the sheets removed from said sheet stacks, a sheet guide positioned intermediate said feeder and said collector conveyor and inclined at an angle off the vertical for guiding said removed sheets slidably therealong and edgewise onto said receivers, said receivers each having a back wall at least substantially parallel to said guide and faced upwardly for uprightly supporting said removed sheets on edge, and said receivers each having a flat bottom for upwardly supporting said sheets in side-by-side relation.

5. The sheet gathering apparatus as claimed in claim 4, wherein said sheet stacks are in a twelve o'clock position relative to an axial view of said rotatable feeder, and said sheet guide is in a position tangential to four o'clock relative to an axial view of said rotatable feeder.

6. The sheet gathering apparatus as claimed in claim 5, wherein said buckets include another wall parallel to the first said wall and a third wall extending between said first wall and said another wall to comprise three walls angularly related for supporting and retaining said removed sheets therein.

7. A sheet gathering apparatus for collecting a plurality of folded sheets together from a row of a plurality of sheet stacks and in a side-by-side relationship, comprising a rotatable gripper cylinder disposed beneath each of said sheet stacks for removing sheets from said sheet stacks, a sheet gripper on each of said gripper cylinders for engaging the folded edge of a sheet in said sheet stack and leading said sheet edgewise around said gripper cylinder with the fold as the leading edge, a collector conveyor movably extending past said gripper cylinders, a plurality of buckets attached spaced apart on said collector conveyor and having an upwardly faced opening for receiving said removed sheets, a sheet guide adjacent said gripper cylinder and disposed at an angle off vertical for encountering said removed sheets and directing same into said buckets, said buckets having a wall substantially parallel to said guide for uprightly supporting said removed sheets in said buckets in side-by-side relationship.

* * * * *